US011171428B2

(12) United States Patent
Maehori et al.

(10) Patent No.: US 11,171,428 B2
(45) Date of Patent: Nov. 9, 2021

(54) TERMINAL METAL PART WITH PROTECTIVE FILM LAYERS TO SUPPRESS GALVANIC CORROSION

(71) Applicant: Yazaki Corporation, Tokyo (JP)

(72) Inventors: Seiko Maehori, Makinohara (JP); Hirohito Nakata, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 20 days.

(21) Appl. No.: 16/578,584

(22) Filed: Sep. 23, 2019

(65) Prior Publication Data

US 2020/0127392 A1 Apr. 23, 2020

(30) Foreign Application Priority Data

Oct. 22, 2018 (JP) ..... JP2018-198333

(51) Int. Cl.

| | |
|---|---|
| ***H01R 4/58*** | (2006.01) |
| ***H01R 4/18*** | (2006.01) |
| ***H01R 13/03*** | (2006.01) |
| ***H01R 4/62*** | (2006.01) |

(52) U.S. Cl.

CPC ..... *H01R 4/58* (2013.01); *H01R 4/185* (2013.01); *H01R 4/62* (2013.01); *H01R 13/03* (2013.01)

(58) Field of Classification Search

CPC ..... H01R 4/58; H01R 4/185; H01R 13/03; H01R 4/62; H01R 43/16

USPC ..... 439/877, 886, 887

See application file for complete search history.

(56) References Cited

U.S. PATENT DOCUMENTS

| | | | | |
|---|---|---|---|---|
| 6,451,449 | B2 | 9/2002 | Asakura et al. | |
| 7,357,681 | B2 * | 4/2008 | Yamagami | H01R 13/03 439/886 |
| 8,487,183 | B2 * | 7/2013 | Schulte | H01R 4/029 174/94 R |
| 8,641,461 | B2 | 2/2014 | Mitose et al. | |
| 8,915,761 | B2 * | 12/2014 | Kakuta | C23C 28/021 439/877 |
| 9,022,821 | B2 * | 5/2015 | Matsushita | H01R 4/20 439/887 |
| 9,484,642 | B2 * | 11/2016 | Okuno | C25D 7/00 |
| 9,490,550 | B2 * | 11/2016 | Otsuka | H01R 4/62 |

(Continued)

FOREIGN PATENT DOCUMENTS

| | | | |
|---|---|---|---|
| CN | 1184344 | A | 6/1998 |
| CN | 102742083 | A | 10/2012 |

(Continued)

*Primary Examiner* — Travis S Chambers

(74) *Attorney, Agent, or Firm* — Sughrue Mion, PLLC

(57) ABSTRACT

A terminal metal part is provided which can suppress changes in characteristic regarding the connection while suppressing galvanic corrosion. In the terminal metal part, a tin plating layer is formed thicker in a crimping region with a conductor crimping lug than in an electric connecting region contactable with a mating terminal. With this, it is difficult for the conductor section and an alloy section as a base under the tin plating layer in the crimping region to come into a direct contact with each other, which can suppress galvanic corrosions. Furthermore, forming the tin plating layer can have less influence in the electric connecting region and changes in characteristics regarding the connection to the mating terminal can be suppressed.

9 Claims, 7 Drawing Sheets

(56) References Cited

U.S. PATENT DOCUMENTS

| | | | | |
|---|---|---|---|---|
| 9,537,243 | B2 * | 1/2017 | Gaertner | C25D 7/00 |
| 2001/0008709 | A1 * | 7/2001 | Asakura | H01R 13/03 428/647 |
| 2011/0225820 | A1 | 9/2011 | Kondo et al. | |
| 2012/0115375 | A1 * | 5/2012 | Kakuta | C25D 5/44 439/877 |
| 2014/0302729 | A1 | 10/2014 | Kodama et al. | |
| 2016/0359244 | A1 * | 12/2016 | Tachibana | H01R 4/18 |
| 2020/0259274 | A1 * | 8/2020 | Kubota | C22C 18/00 |

FOREIGN PATENT DOCUMENTS

| | | | |
|---|---|---|---|
| JP | 11-121075 | A | 4/1999 |
| JP | 2009-152052 | A | 7/2009 |
| JP | 2013-127907 | A | 6/2013 |
| JP | 2013-134891 | A | 7/2013 |
| JP | 2013-149598 | A | 8/2013 |
| JP | 2013-182861 | A | 9/2013 |
| JP | 2013-218866 | A | 10/2013 |

* cited by examiner

TERMINAL METAL PART WITH PROTECTIVE FILM LAYERS TO SUPPRESS GALVANIC CORROSION

BACKGROUND OF THE INVENTION

Technical Field

The present invention relates to a terminal metal part to be connected to a conductor section which is exposed at an end of a coated electric wire.

Background Art

Generally, a terminal metal part may be connected to an end of a coated electric wire by crimping in a conductor section which is exposed. In this case, an intrusion of moisture into an interface between them may form a local electric cell when the conductor section and the terminal metal part are formed from metals different from each other which may lead to a galvanic corrosion. Therefore, a terminal metal part has been proposed which has a protection film formed on its surface (see also e.g. Patent Documents 1-6). According to the Patent Documents 1-6, a terminal metal part has a tin plating layer etc. formed on it as the protection film wherein galvanic corrosions are suppressed in a region in contact with a conductor section.

PATENT LITERATURE

Patent Document 1: JP 2009-152052 A
Patent Document 2: JP 2013-149598 A
Patent Document 3: JP 2013-127907 A
Patent Document 4: JP 2013-218866 A
Patent Document 5: JP 2013-182861 A
Patent Document 6: JP 2013-134891 A

SUMMARY OF THE INVENTION

However, the terminal metal part is connected to the conductor section by crimping (caulking), wherein a base under the protection film may be exposed by deformation of the crimped section. If the exposed base comes into a direct contact with the conductor section, a galvanic corrosion may occur. Therefore, it would be possible to form a thicker protection film; however, such a thicker protection film may cause the risk that characteristics regarding the connection (deformability or friction force of the terminal metal part etc.) may be changed in an electric contact section of the terminal metal part, which comes into contact with a mating terminal.

The objective of the present invention is to provide a terminal metal part which can suppress changes in characteristic regarding the connection while suppressing galvanic corrosion.

The present invention relates to a terminal metal part to be connected to a conductor section which is exposed at an end of a coated electric wire, the terminal metal part including: an electric connecting region including an electric connecting section contactable with a mating terminal and a crimping region including a conductor crimping lug to be crimped to the conductor section, wherein the terminal metal part includes a tin plating layer formed on its surface and the tin plating layer is formed thicker in the crimping region than in the electric connecting region, wherein the tin plating layer in the crimping region has such a thickness that a base under the tin plating layer may not be exposed.

With such a terminal metal part according to the present invention, it is difficult for the conductor section and the base under the tin plating layer in the crimping region with the conductor crimping lug to come into a direct contact with each other by forming the tin plating layer thicker in the crimping region than in the electric connecting region to be connected with the mating terminal, which can suppress galvanic corrosions. Moreover, forming the tin plating layer can have less influence in the electric connecting region and changes in characteristics regarding the connection to the mating terminal can be suppressed.

DETAILED DESCRIPTION OF THE PREFERRED EMBODIMENTS

Hereinafter, embodiments of the present invention shall be described with reference to the drawings. It is to be noted that, in the second to fourth embodiments, the same elements and elements with similar functions to those described with regard to the first embodiment are labelled with the same reference signs as in the first embodiment and their explanation shall be omitted.

First Embodiment

Figure 1:
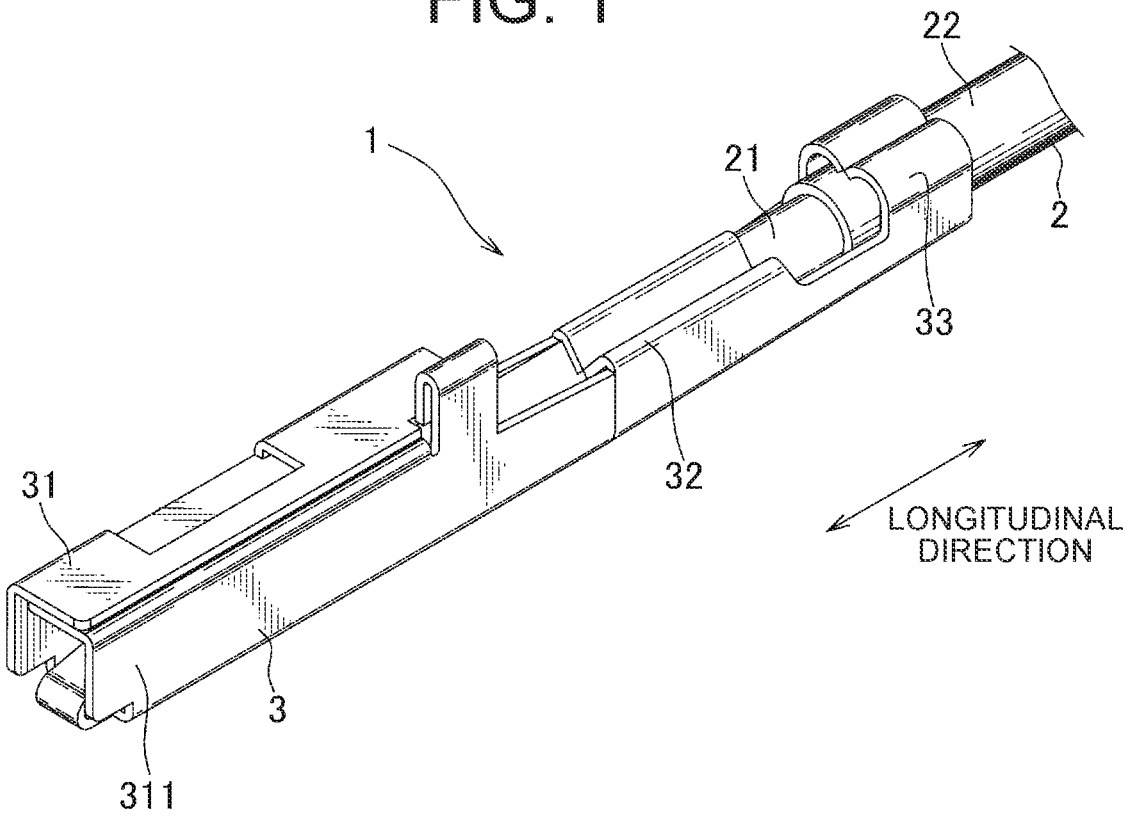
FIG. 1 is a perspective view illustrating an electric wire with a terminal according to a first embodiment of the present invention.

According to the present embodiment, an electric wire with a terminal 1 includes a coated electric wire 2 and a terminal metal part 3 as indicated in FIG. 1, and forms a part of a wire harness such as those arranged in a vehicle.

The coated electric wire 2 includes a conductor section 21 and an insulating sheath 22 covering the conductor section 21. The conductor section 21 is formed e.g. from aluminum or aluminum alloy. It is to be noted that the conductor section 21 may be a stranded wire having a plurality of thin wires or a single conductive wire. The conductor section 21 is exposed at an end of the coated electric wire 2 by removing the insulating sheath 22 at the end.

Figure 2:
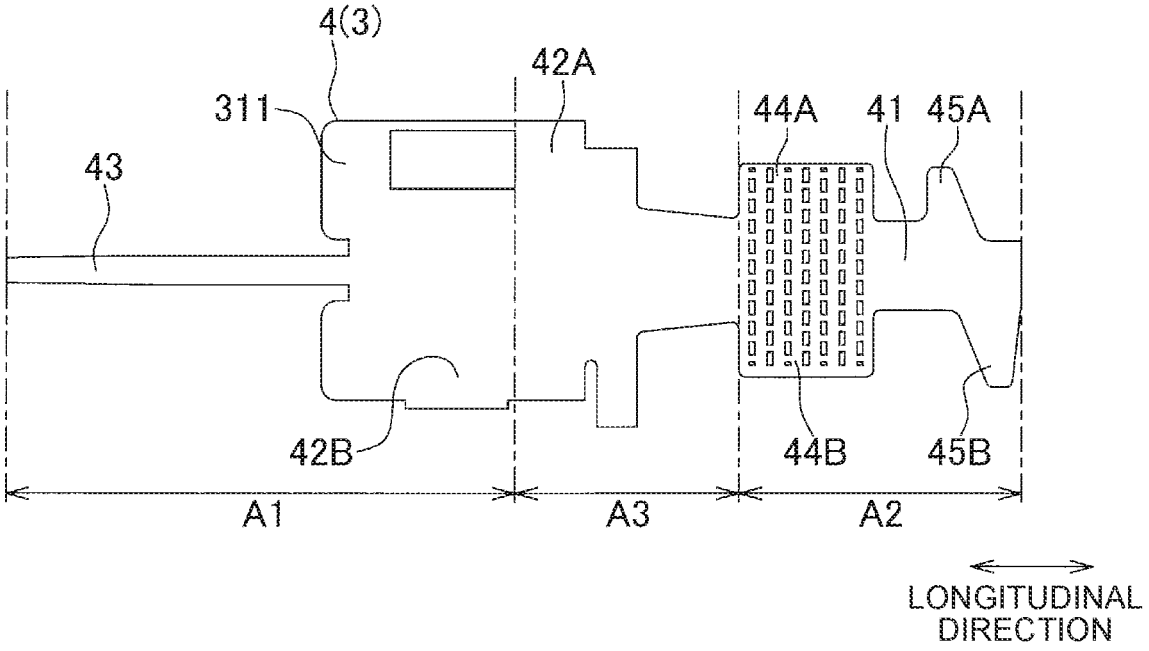
FIG. 2 is a top view illustrating a terminal metal part of the electric wire.

The terminal metal part 3 includes, in order from the front end side, a box-shaped section 31, a conductor connecting section 32 and a sheath connecting section 33. The terminal metal part 3 is assembled by bending a sheet-shaped element 4 as indicated in FIG. 2, and configured to be connected to the coated electric wire 2 with the conductor connecting section 32 and the sheath connecting section 33.

The sheet-shaped element 4 integrally includes a bottom section 41 extending along a longitudinal direction of the coated electric wire 2, a pair of wall sections 42A, 42B configured to clamp the bottom section 41, a ribbon-shaped contact lug 43 which is continuous at the front end side of the bottom section 41, a pair of conductor crimping lugs (barrel) 44A, 44B formed so as to clamp the bottom section 41, and a pair of sheath crimping lugs (barrel) 45A, 45B configured to clamp the bottom section 41, wherein the coated electric wire 2 is laid on the bottom section 41.

Bending the pair of wall sections 42A and 42B results in the bottom section 41 and thus the quadrilateral-tubular box-shaped section 31. The box-shaped section 31 is opened at the front end side, wherein a contact lug 43 is bent near the opening to extend towards the inside of the quadrilateral tube. It is provided that a mating terminal may be inserted through the opening into the box-shaped section 31 and a predetermined insertion pressure can be obtained by deformation of the contact lug 43. A section of the box-shaped section 31 which comes into contact with the mating terminal forms an electric connecting section 311.

The pair of conductor crimping lugs 44A and 44B is bent so as to stand upright from the bottom section 41 and thereafter caulked and crimped to the conductor section 21. I.e., the conductor connecting section 32 is formed from the pair of conductor crimping lugs 44A, 44B and the bottom section 41.

The pair of sheath crimping lugs 45A and 45B is bent so as to stand upright from the bottom section 41 and thereafter caulked and crimped to the insulating sheath 22. I.e., the sheath connecting section 33 is formed from the pair of sheath crimping lugs 45A, 45B and the bottom section 41.

Of the sheet-shaped element 4, a region corresponding to the electric connecting section 311 is an electric connecting region A1, a region corresponding to the conductor connecting section 32 and the sheath connecting section 33 is a crimping region A2, and a region interposed between the electric connecting region A1 and the crimping region A2 is an intermediate region A3. In other words, the electric connecting region A1 includes the electric connecting section 311, and the crimping region A2 includes the pair of conductor crimping lugs 44A and 44B. It is to be noted that the intermediate region A3 includes a section of the box-shaped section 31 which does not come into contact with the mating terminal, and a section between the wall sections 42A, 42B and the conductor crimping lugs 44A, 44B.

Figure 3:
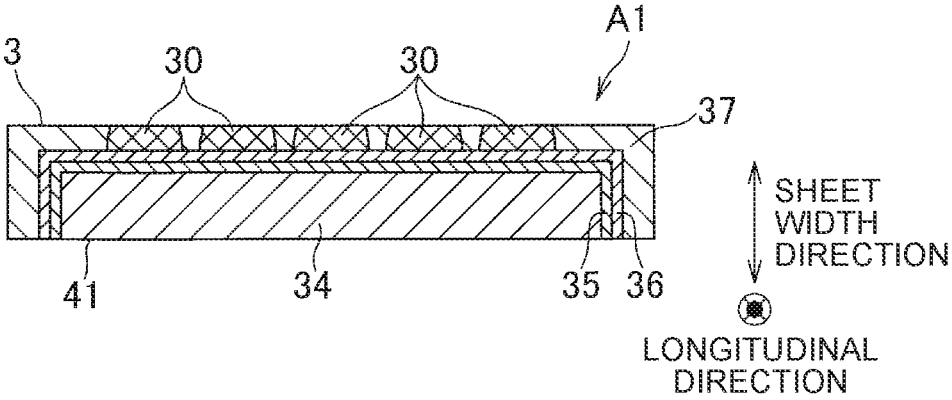
FIG. 3 is a sectional view illustrating a cross section in an electric connecting region of the terminal metal part.
Figure 4:
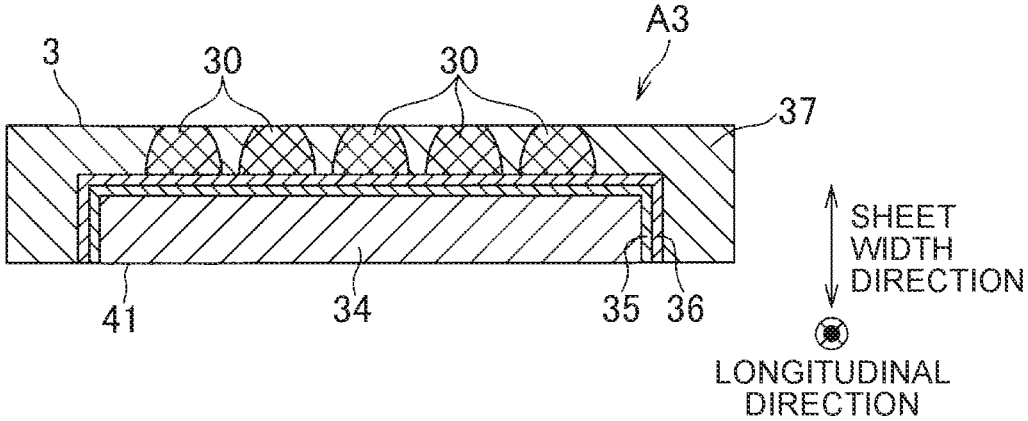
FIG. 4 is a sectional view illustrating a cross section in an intermediate region of the terminal metal part.
Figure 5:
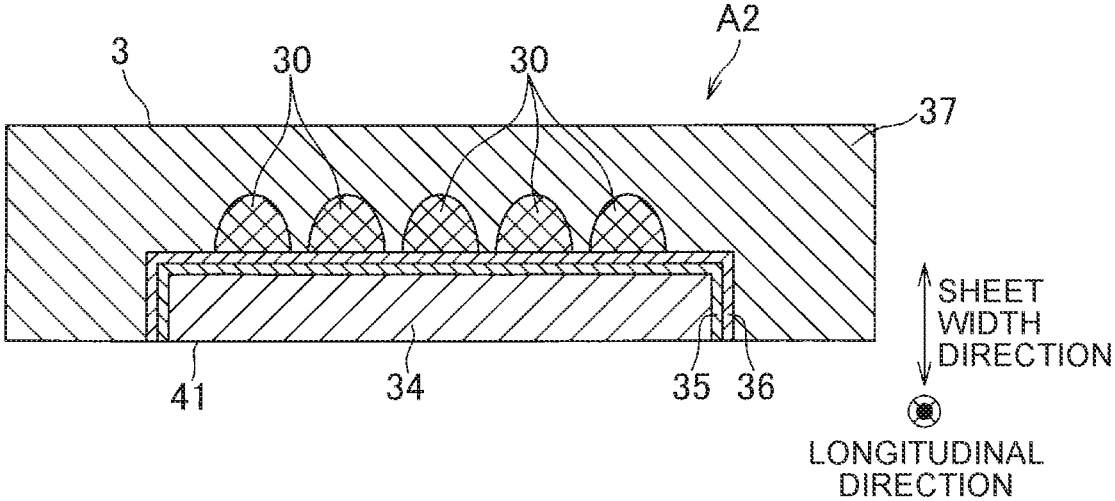
FIG. 5 is a sectional view illustrating a cross section in the crimping region of the terminal metal part.

The terminal metal part 3 is formed, as indicated in FIGS. 3-5, by stacking a nickel layer (base layer) 35, a copper layer (intermediate layer) 36 and a tin plating layer 37 in this order onto the substrate 34 made of copper. It is noted that, the layers 35-37 may be formed on both side of the terminal metal part 3, although in the shown example, they are formed only on a side of the terminal metal part 3 on which the coated electric wire 2 is to be arranged.

A reaction of the copper layer 36 with the tin plating layer 37 due to heat etc. results in alloy sections 30 of copper and tin between them. The alloy sections 30 have e.g. a protruding form which has a protruding direction extending in a sheet width direction of the bottom section 41, wherein an in-plane size of the protruding form is reduced towards the front end side.

FIG. 3 shows a cross section of the bottom section 41 in the electric connecting region A1, FIG. 4 shows a cross section of the bottom section 41 in the intermediate region A3, and FIG. 5 shows a cross section of the bottom section 41 in the crimping region A2. The nickel layer 35 and the copper layer 36 have substantially constant thicknesses in all of the regions A1-A3.

The tin plating layer 37 is formed thicker in the crimping region A2 than in the electric connecting region A1. Here, the tin plating layer 37 has a substantially constant thickness in each of the electric connecting region A1 and the crimping region A2, wherein the tin plating layer 37 is formed in the intermediate region A3 so that its thickness increases from the electric connecting region A1 to the crimping region A2.

The tin plating layer 37 preferably has a thickness of 1 μm or smaller in the electric connecting region A1 and a thickness of 3 μm or larger in the crimping region A2. Here, it is sufficient if the thickness in the intermediate region A3 is e.g. 1-3 μm. As seen from the above description, it is preferable that the tin plating layer 37 is thicker in the crimping region A2 by a factor of 3 or more than in the electric connecting region A1.

In the electric connecting region A1 and the intermediate region A3, the alloy sections 30 extend through the tin plating layer 37 and is exposed. On the other hand, the alloy sections 30 are not exposed in the crimping region A2 (i.e., they are covered with the tin plating layer 37).

The nickel layer 35 has a substantially constant thickness, e.g. of 0.2 μm, in all of the regions A1-A3. The copper layer 36 has a substantially constant thickness, e.g. of 0.4 μm, in all of the regions A1-A3. It is to be noted that the thickness of the respective layers may have some tolerance (e.g. ±0.02 μm).

Figure 6:
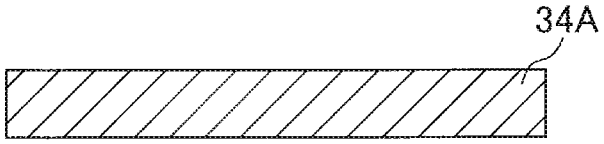
FIG. 6 is a sectional view illustrating a copper substrate material forming a substrate of the terminal metal part.
Figure 7:
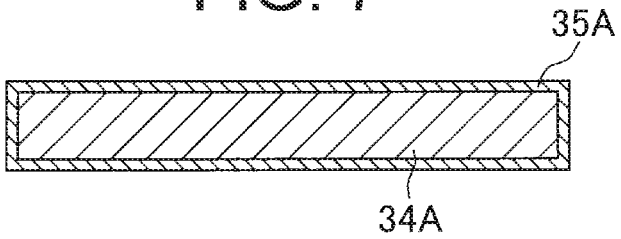
FIG. 7 is a sectional view illustrating how a nickel base layer is formed on a surface of the copper substrate material.
Figure 8:
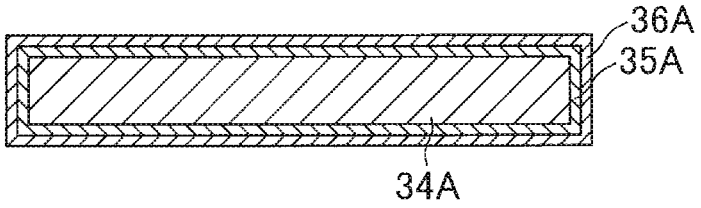
FIG. 8 is a sectional view illustrating how a copper intermediate layer is formed on a surface of the nickel base layer.

Here, a method for forming the nickel layer 35, the copper layer 36 and the tin plating layer 37 on a surface of the substrate 34 shall be described. At first, a nickel base layer 35A (which corresponds to the nickel layer 35) is formed on a surface of a copper substrate material 34A (which corresponds to the substrate 34) as indicated in FIG. 6 by base preparation, as indicated in FIG. 7. Furthermore, as indicated in FIG. 8, a copper intermediate layer 36A (which corresponds to the copper layer 36) is formed on a surface the nickel base layer 35A by base preparation. Here, the both of the right and left sides in FIG. 6 correspond to end surfaces of the sheet-shaped element 4.

Figure 9:
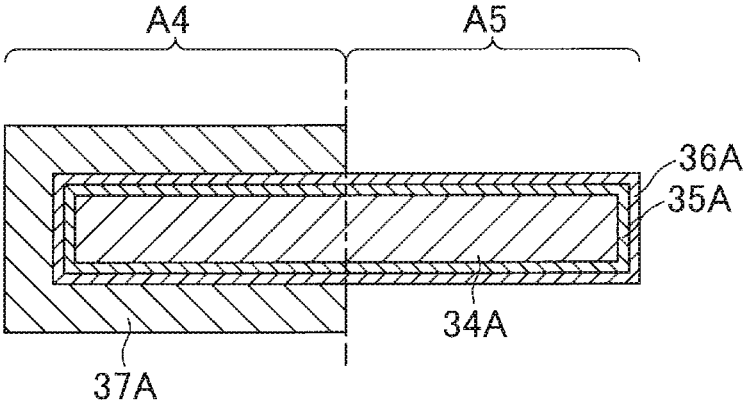
FIG. 9 is a sectional view illustrating how a tin reflow layer is formed in a first region of a surface of the copper intermediate layer.
Figure 10:
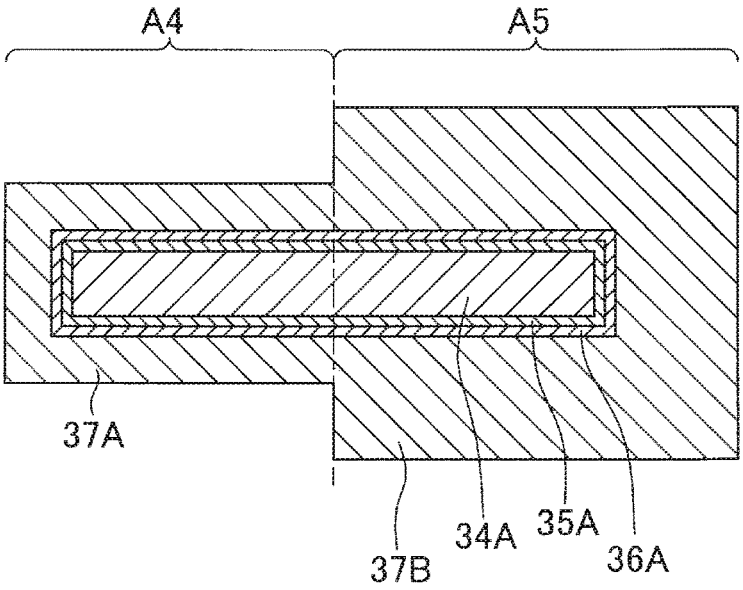
FIG. 10 is a sectional view illustrating how a tin mat layer in a second region of the surface of the copper intermediate layer.

Next, as indicated in FIG. 9, a tin reflow layer 37A (which corresponds to the tin plating layer 37) is formed in a first region A4 of a surface of the copper intermediate layer 36A by tin reflow process. Furthermore, as indicated in FIG. 10, a tin mat layer 37B (which corresponds to the tin plating layer 37) is formed in a second region A5 of the surface of the copper intermediate layer 36A by tin matting process.

The first region A4 includes the above described electric connecting region A1, i.e. the electric connecting section 311. The second region A5 includes the above described crimping region A2, i.e. the pair of conductor crimping lugs 44A and 44B. Here, the intermediate region A3 stretches from the first region A4 to the second region A5. In this manner, the tin plating layer 37 can be formed thicker in the crimping region A2 than in the electric connecting region A1 by forming the tin reflow layer 37A in the first region A4 including the electric connecting region A1 with the tin reflow process and by forming the tin mat layer 37B in the second region A5 including the crimping region A2 with the tin matting process.

It is to be noted that, in the second to fourth embodiments as described below, the steps for forming the nickel base layer 35A and the copper intermediate layer 36A may be omitted when appropriate, it is sufficient if the tin reflow layer 37A and the tin mat layer 37B are formed on a suitable one of the copper substrate material 34A, the nickel base layer 35A and the copper intermediate layer 36A (the nickel base layer 35A and the copper intermediate layer 36A shall be referred to collectively as a "base layer").

The present embodiment as described above has the following effects: forming the tin plating layer 37 thicker in the crimping region A2 with the conductor crimping lugs 44A and 44B than in the electric connecting region A1 in contact with the mating terminal can cause that the conductor section 21 and the alloy sections 30 which are bases under the tin plating layer 37 in the crimping region A2 can be difficult to come into a direct contact with each other, which can suppress galvanic corrosions. Furthermore, forming the tin plating layer 37 may have less influence in the electric connecting region A1 and the changes in characteristics regarding the connection to the mating terminal can be suppressed.

Moreover, if the thickness of the tin plating layer 37 in the crimping region A2 is larger by a factor of 3 or more than in the electric connecting region A1, a further suppression of the galvanic corrosions and a further suppression of the changes in characteristics regarding the connection to the mating terminal can be achieved.

Furthermore, if the thickness of the tin plating layer 37 is 3 μm or larger in the crimping region A2 and 1 μm or smaller in the electric connecting region A1, a further suppression of the galvanic corrosions and a further suppression of the changes in characteristics regarding the connection to the mating terminal can be achieved.

Second Embodiment

Figure 11:
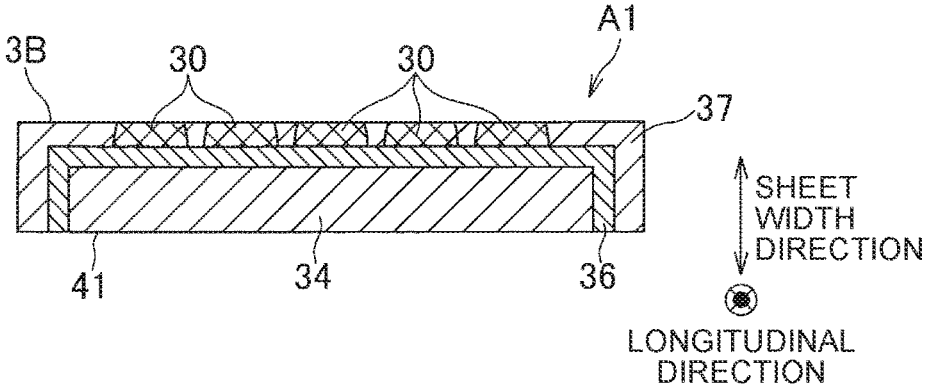
FIG. 11 is a sectional view illustrating a cross section of an electric connecting region of a terminal metal part of an electric wire with a terminal according to a second embodiment of the present invention.
Figure 12:
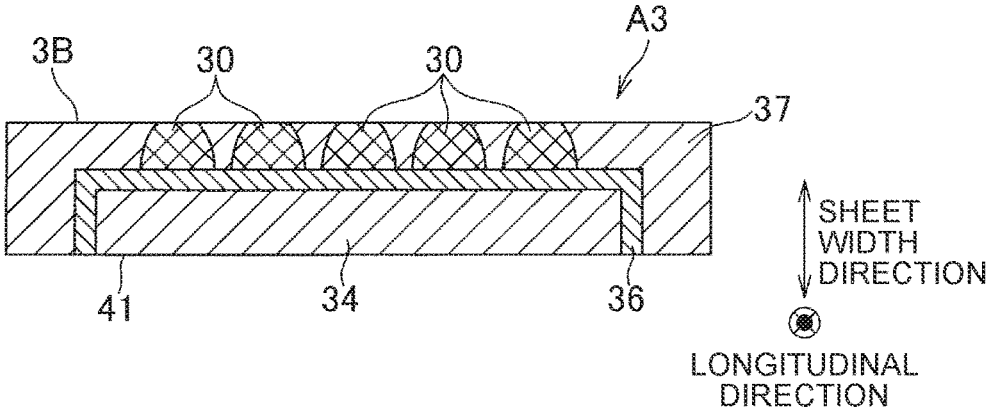
FIG. 12 is a sectional view illustrating a cross section in an intermediate region of the terminal metal part.
Figure 13:
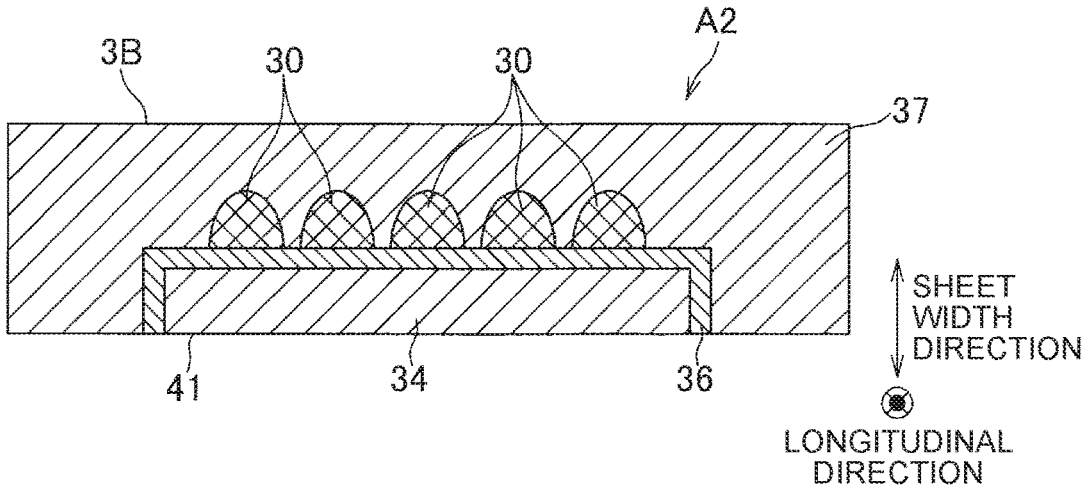
FIG. 13 is a sectional view illustrating a cross section in a crimping region of the terminal metal part.

According to the present embodiment, an electric wire with a terminal includes a coated electric wire 2 and a terminal metal part 3B as indicated in FIGS. 11-13. The terminal metal part 3B, analogously to the terminal metal part 3 according to the first embodiment, includes a box-shaped section 31, a conductor connecting section 32 and a sheath connecting section 33. The terminal metal part 3B differs from the terminal metal part 3 according to the first embodiment in that the nickel layer 35 is omitted.

Namely, the terminal metal part 3B is configured by stacking the copper layer (base layer) 36 and the tin plating layer 37 on a surface of the substrate 34 in this order. FIG. 11 shows a cross section of the bottom section 41 in the electric connecting region A1, FIG. 12 a cross section of the bottom section 41 in the intermediate region A3, and FIG. 13 a cross section of the bottom section 41 in the crimping region A2.

In the terminal metal part 3B, thicknesses of the copper layer 36 and the tin plating layer 37 are similar to those in the first embodiment. Furthermore, alloy sections 30 are formed in the terminal metal part 3B in an analogue manner as the terminal metal part 3 according to the first embodiment.

With the present embodiment as described above, the following effects can be achieved: forming the tin plating layer 37 thicker in the crimping region A2 than in the electric connecting region A1 can cause that the conductor section 21 and the alloy sections 30 which are bases under the tin plating layer 37 in the crimping region A2 can be difficult to come into a direct contact with each other, which can suppress galvanic corrosions. Furthermore, forming the tin plating layer 37 may have less influence in the electric connecting region A1 and the changes in characteristics regarding the connection to the mating terminal can be suppressed.

Third Embodiment

Figure 14:
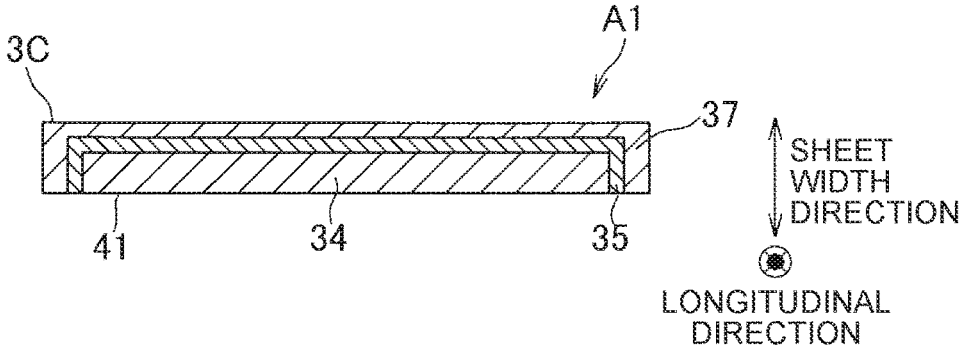
FIG. 14 is a sectional view illustrating a cross section in an electric connecting region of a terminal metal part of an electric wire with a terminal according to a third embodiment of the present invention.
Figure 15:
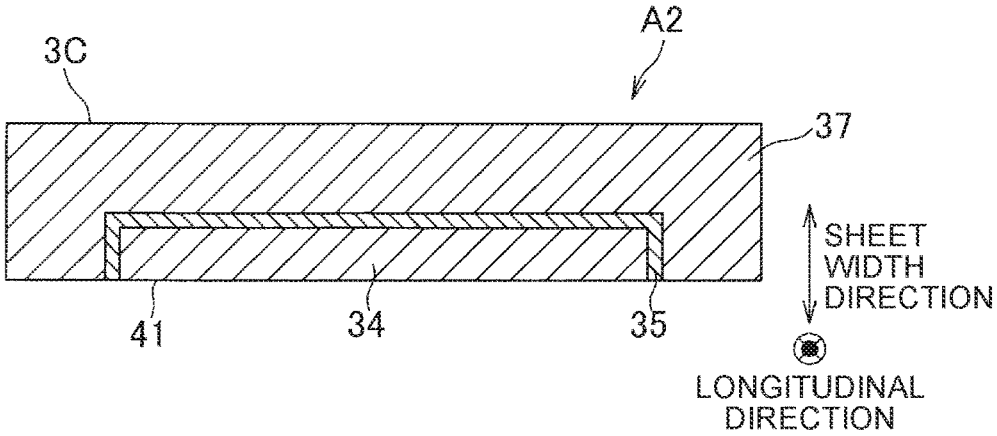
FIG. 15 is a sectional view illustrating a cross section in a crimping region of the terminal metal part.

According to the present embodiment, an electric wire with a terminal includes a coated electric wire 2 and a terminal metal part 3C as indicated in FIGS. 14 and 15. The terminal metal part 3C, analogously to the terminal metal part 3 according to the first embodiment, includes a box-shaped section 31, a conductor connecting section 32 and a sheath connecting section 33. The terminal metal part 3C differs from the terminal metal part 3 according to the first embodiment in that the copper layer 36 is omitted.

Namely, the terminal metal part 3C is configured by stacking the nickel layer (base layer) 35 and the tin plating layer 37 on a surface of the substrate 34 in this order. FIGS. 14 and 15 show cross sections of the bottom section 41 in the electric connecting region A1 and in the crimping region A2, respectively.

In the terminal metal part 3C, thicknesses of the nickel layer 35 and the tin plating layer 37 are similar to those in the first embodiment. Furthermore, in contrary to the terminal metal part 3 according to the first embodiment, no alloy section 30 is formed since no copper layer is formed in the terminal metal part 3C.

When the conductor crimping lugs 44A and 44B are crimped to the conductor section 21, the tin plating layer 37 in the crimping region A2 may be removed to some extent. In this case, the nickel layer 35 as the base is difficult to be exposed by forming the tin plating layer 37 thicker in the crimping region A2.

With the present embodiment as described above, the following effects can be achieved: forming the tin plating layer 37 thicker in the crimping region A2 than in the electric connecting region A1 can cause that the conductor section 21 and the nickel layer 35 which is the base under the tin plating layer 37 in the crimping region A2 can be difficult to come into a direct contact with each other, which can suppress galvanic corrosions. Furthermore, forming the tin plating layer 37 may have less influence in the electric connecting region A1 and the changes in characteristics regarding the connection to the mating terminal can be suppressed.

Fourth Embodiment

Figure 16:
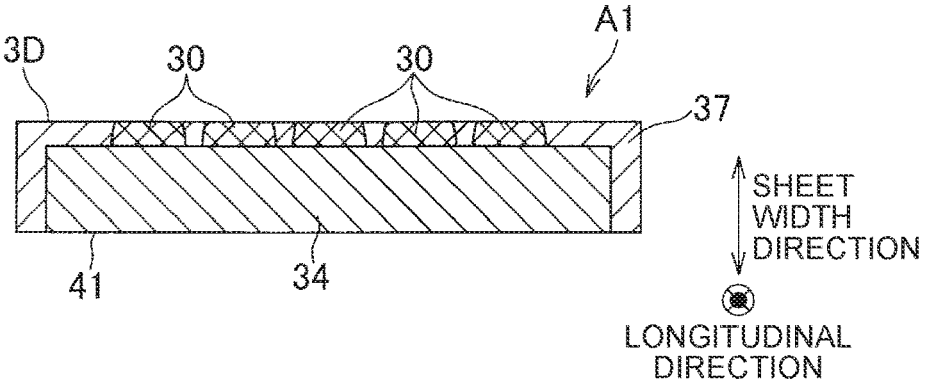
FIG. 16 is a sectional view illustrating a cross section in an electric connecting region of a terminal metal part of an electric wire with a terminal according to a fourth embodiment of the present invention.
Figure 17:
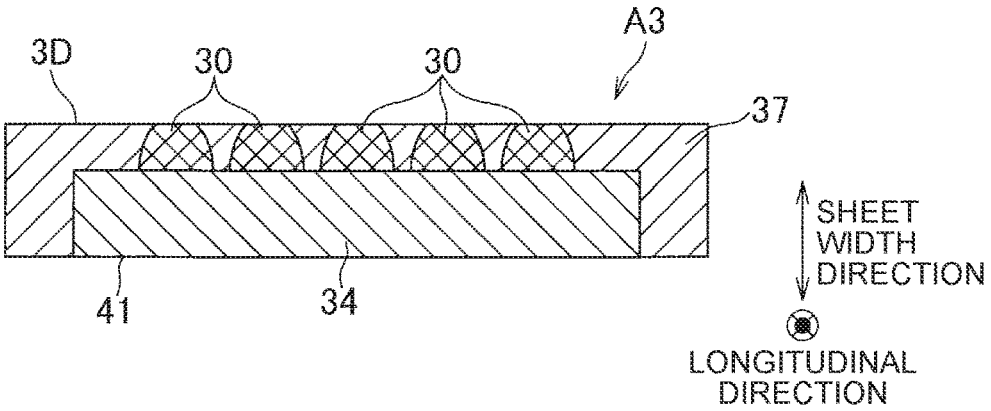
FIG. 17 is a sectional view illustrating a cross section in an intermediate region of the terminal metal part.
Figure 18:
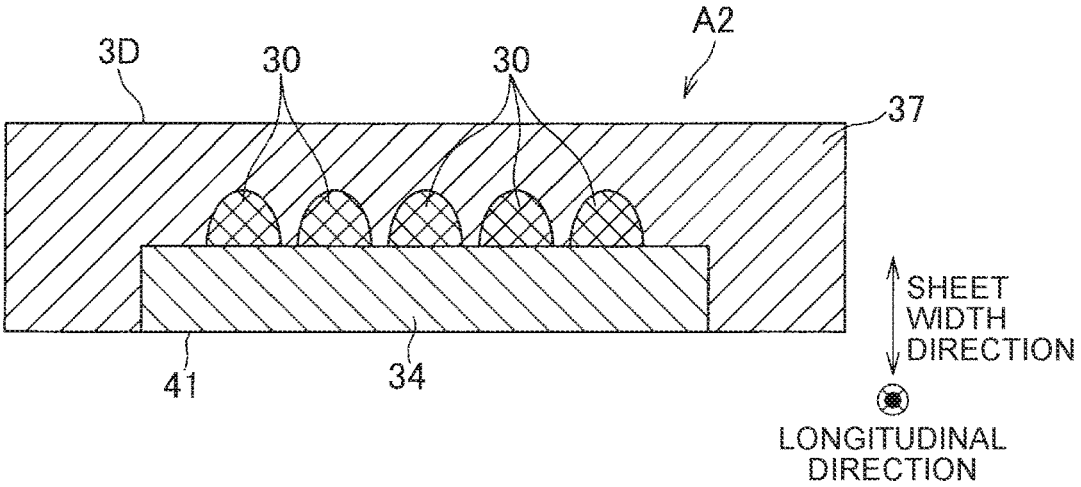
FIG. 18 is a sectional view illustrating a cross section in a crimping region of the terminal metal part.

According to the present embodiment, an electric wire with a terminal includes a coated electric wire 2 and a terminal metal part 3D as indicated in FIGS. 16-18. The terminal metal part 3D, analogously to the terminal metal part 3 according to the first embodiment, includes a box-shaped section 31, a conductor connecting section 32 and a sheath connecting section 33. The terminal metal part 3D differs from the terminal metal part 3 according to the first embodiment in that the nickel layer 35 and the copper layer 36 are omitted.

Namely, the terminal metal part 3D is configured by stacking the tin plating layer 37 directly on a surface of the substrate 34. FIGS. 16, 17 and 18 show cross sections of the bottom section 41 in the electric connecting region A1, in the intermediate region A3 and in the crimping region A2, respectively.

In the terminal metal part 3D, a thickness of the tin plating layer 37 is similar to that in the first embodiment. Furthermore, alloy sections 30 are formed in the terminal metal part 3D in an analogue manner as the terminal metal part 3 according to the first embodiment.

With the present embodiment as described above, the following effects can be achieved: forming the tin plating layer 37 thicker in the crimping region A2 than in the electric connecting region A1 can cause that the conductor section 21 and alloy sections 30 which are bases under the tin plating layer 37 in the crimping region A2 can be difficult to come into a direct contact with each other, which can suppress galvanic corrosions. Furthermore, forming the tin plating layer 37 may have less influence in the electric connecting region A1 and the changes in characteristics regarding the connection to the mating terminal can be suppressed.

It is to be noted that the present invention is not limited to the above embodiments, but includes further features which can achieve the objective of the present invention, wherein variations as shown below are also included.

For example, although in the first embodiment, the thickness of the tin plating layer 37 is preferably 1 μm or smaller in the electric connecting region A1, preferably 3 μm or larger in the crimping region A2, wherein the thickness of the tin plating layer 37 in the crimping region A2 is preferably larger by a factor of 3 or more than in the electric connecting region A1, these dimensions may be determined in a suitable manner in each case.

This means that, the thickness in the crimping region A2 may be smaller than 3 μm, when it is difficult e.g. to expose the base under the tin plating layer 37, the thickness in the electric connecting region A1 may be larger than 1 μm when it is difficult to change characteristics regarding the connection to the mating terminal by forming the tin plating layer 37.

Furthermore, while in the above embodiments, the tin plating layer 37 has such a thickness in the crimping region A2 that the base is not be exposed, the base may be exposed to some extent. Even in this case, an exposed area of the base may be smaller by forming the tin plating layer 37 thicker in the crimping region A2 than in the electric connecting region A1, which can suppress galvanic corrosions.

Figure 19:
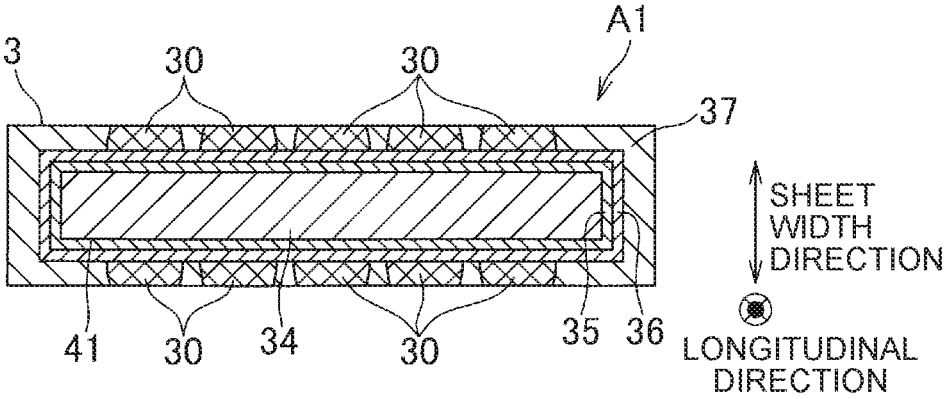
FIG. 19 is a sectional view illustrating a terminal metal part of an electric wire with a terminal according to an example of variation of the present invention.

Moreover, while in the above embodiments, the tin plating layer 37 is formed only on one side (surface) and lateral surfaces of the substrate 34, it may be also provided that both of the front and back sides as well as lateral surfaces of the substrate 34 may be covered with the tin plating layer 37, as indicated in FIG. 19. In this context, although FIG. 19 shows only the electric connecting region A1, it is sufficient if the regions A2 and A3 have same configurations. Furthermore, the nickel layer 35 and the copper layer 36 may be omitted when appropriate. Moreover, configurations without the nickel layer 35 and/or the copper layer 36 such as the second to fourth embodiments may have the tin plating layer 37 on the back side of the substrate 34.

It is also noted that, although the best configurations and methods etc. for implementing the present invention are disclosed in the above description, the present invention is not limited thereto. This means that, although the present invention is especially shown and described mainly with respect to certain embodiments, various modifications may be made by those skilled in the art to the above described embodiments in forms, material characteristics, amounts and other details. Consequently, limiting statements with regard to forms and material characteristics etc. disclosed above are used only as examples for easily understanding the present invention and do not limit the present invention. Therefore, statements using element names without some or all of the limitations in material characteristics etc. are also included in the present invention.

REFERENCE SIGNS LIST

2 coated electric wire
21 conductor section
3, 3B, 3C terminal metal part
311 electric connecting section
34 substrate
35 nickel layer
36 copper layer
37 tin plating layer
44A, 44B conductor crimping lugs
A1 electric connecting region
A2 crimping region

What is claimed is:

1. A terminal metal part to be connected to a conductor section which is exposed at an end of a coated electric wire, the terminal metal part comprising:

an electric connecting region including an electric connecting section contactable with a mating terminal; and a crimping region including a conductor crimping lug to be crimped to the conductor section, wherein the terminal metal part includes a tin plating layer formed on its surface and the tin plating layer is formed thicker in the crimping region than in the electric connecting region;

wherein the tin plating layer in the crimping region has such a thickness that a base under the tin plating layer is not be exposed, wherein the thickness of the tin plating layer in the electric connecting region is 1 μm or smaller, wherein the thickness of the tin plating layer in the crimping region is 3 μm or larger, wherein the thickness of the tin plating layer in the crimping region is 3 or more times larger than the thickness of the tin plating layer in the electric connecting region, wherein the tin plating layer in the electric connecting region is a tin reflow layer, and wherein the tin plating layer in the crimping region is a tin mat layer.

2. The terminal metal part according to claim 1, wherein a nickel layer, a copper layer and the tin plating layer are formed in this order onto a substrate made of copper.

3. The terminal metal part according to claim 2, wherein both of a front and a back side as well as lateral surfaces of the substrate are covered with the tin plating layer.

4. The terminal metal part according to claim 1, wherein a copper layer and the tin plating layer are formed in this order onto a substrate made of copper.

5. The terminal metal part according to claim 4, wherein both of a front and a back side as well as lateral surfaces of the substrate are covered with the tin plating layer.

6. The terminal metal part according to claim 1, wherein a nickel layer and the tin plating layer are formed in this order onto a substrate made of copper.

7. The terminal metal part according to claim 6, wherein both of a front and a back side as well as lateral surfaces of the substrate are covered with the tin plating layer.

8. The terminal metal part according to claim 1, wherein the tin plating layer is formed onto a substrate made of copper.

9. The terminal metal part according to claim 8, wherein both of a front and a back side as well as lateral surfaces of the substrate are covered with the tin plating layer.

* * * * *